US007783066B2

(12) United States Patent
Naylor

(10) Patent No.: US 7,783,066 B2
(45) Date of Patent: Aug. 24, 2010

(54) METHOD FOR IMPROVING THE FITTING OF HEARING AIDS AND DEVICE FOR IMPLEMENTING THE METHOD

(75) Inventor: Graham Naylor, DK3450 Allerød (DK)
(73) Assignee: Oticon A/S, Smørum (DK)

( * ) Notice: Subject to any disclaimer, the term of this patent is extended or adjusted under 35 U.S.C. 154(b) by 875 days.

(21) Appl. No.: 11/588,353

(22) Filed: Oct. 27, 2006

(65) Prior Publication Data

US 2007/0127751 A1 Jun. 7, 2007

Related U.S. Application Data

(63) Continuation of application No. 10/169,793, filed as application No. PCT/DK01/00038 on Jan. 18, 2001, now abandoned.

(30) Foreign Application Priority Data

Jan. 21, 2000 (DK) ..... 2000 00110

(51) Int. Cl.
*H04R 25/00* (2006.01)

(52) U.S. Cl. ..... 381/312; 381/314
(58) Field of Classification Search ..... 381/58, 381/60, 312, 314; 73/585; 600/559
See application file for complete search history.

(56) References Cited

U.S. PATENT DOCUMENTS 5,710,819 A * 1/1998 Tøpholm et al. ..... 381/316

* cited by examiner

*Primary Examiner*—Tuan D Nguyen
(74) *Attorney, Agent, or Firm*—Dykema Gossett PLLC

(57) ABSTRACT

The invention relates to a method for fitting a hearing aid to the needs of a hearing aid user, the method comprising collecting statistical data characterising physical or psychological properties of environments in which use of the hearing aid is desired and utilising the statistical values for the adjustment of the signal processing in the hearing aid, such statistical data having influence even though they may have been collected prior to the wearer's first or current period of listening via the hearing aid. The invention further relates to a device for implementing the method.

11 Claims, 2 Drawing Sheets

METHOD FOR IMPROVING THE FITTING OF HEARING AIDS AND DEVICE FOR IMPLEMENTING THE METHOD

CROSS-REFERENCE TO RELATED APPLICATION

This application is a continuation of U.S. application Ser. No. 10/169,793, filed Sep. 24, 2002, now abandoned which was a U.S. national phase filing of PCT/DK01/00038, filed 18 Jan. 2001. All priorities are claimed.

FIELD OF THE INVENTION

The invention relates to the optimal adjustment of the signal processing in a hearing aid for the range of environments in which it is intended for use. More specifically the invention relates to a method for individual fitting of a hearing aid and device adapted for facilitating this individual fitting.

BACKGROUND OF THE INVENTION

Today it is normal to adjust the signal processing parameters of a hearing aid for the individual patient by means of audiometric data defining the patient's hearing loss in a predefined frequency range, combined with a prescriptive amplification rationale which has proven suitable for the given patient's type of hearing loss. It is widely accepted that such a fitting will in most cases only give rough estimate of the optimum hearing aid setting for the patient. It is therefore common practice subsequently to carry out a fine-tuning of the hearing aid's signal processing parameters in order to improve the sound quality as received by the patient. Such fine-tuning is normally based on subjective opinions expressed by the patient after using the hearing aid for sometime. In this way it is possible to account in a rough way for the actual circumstances in which the patient spends time using the hearing aid. This approach relies on the dispenser to interpret the patient's description of specific listening situations, assess what acoustical or other features of those situations are causing difficulties, and specify appropriate alterations to the signal processing parameters of the hearing aid.

The objective of the present invention is to provide a method for fitting a hearing aid that is less time-consuming and more accurate than the previously known fitting methods.

A further objective of the present invention is to provide a device which is suitable for use in a hearing aid fitting process according to the invention.

SUMMARY OF THE INVENTION

According to the invention the objective relating to the method is achieved by collecting statistical data characterizing physical or psychological properties of environments in which use of the hearing aid is desired and utilizing the statistical data for adjustment of signal processing in the hearing aid, where the statistical data are collected prior to the wearer's first or current period of use of the hearing aid.

By the collecting measurement data describing the environments in-which the hearing aid is to be used prior to the actual use of the hearing aid, it is possible to obtain a more reliable estimate of the actual needs of the hearing aid user. By specifying the alterations to processing on the basis of (a) knowledge about relations between features of listening environments and optimal signal processing for those environments, combined with (b) actual measurements of features of the patient's listening environments, a better approach to the fitting has been achieved and hence a less time-consuming fitting procedure is achievable.

In one embodiment a device is used which will allow collection of data independent of the hearing aid use. This could for example be through use of a device adapted for this purpose whilst the customized parts of the hearing aid are being manufactured, which often takes several days.

In another embodiment the statistical data relating to physical characteristics of environments are coupled with data relating to the significance of these same environments to the user, which provides the possibility of giving certain data a certain weight, hereby achieving a more correct fitting.

In an embodiment the possibility of performing the data collection during normal hearing aid use and in a programming sequence preceding a future user performing a reprogramming based on the collected data is provided.

By providing means for collecting and storing the data prior to the actual use of the hearing aid it is possible to sample long term statistical values and hence obtain a more reliable estimate of the actual needs of the hearing aid user. A better estimate for the initial fitting is achieved. This means that fewer fine tuning sessions are required and hence a less time-consuming fitting procedure is likewise achievable by use of such device.

The inventive device includes normal hearing aid components, i.e., the device is a hearing aid featuring the data collection ability.

A microphone can be included and used for both audio data collection and the sound collection. A further possibility comprises providing a further microphone. A switch may be provided for selecting different modes of the device.

A number of further sensors can be included. The data collected by these sensors may likewise be used in the fitting procedure.

The invention will be described in more detail in the following description of the preferred embodiment with reference to the drawings.

DESCRIPTION OF THE PREFERRED EMBODIMENT

The invention may be implemented in a number of different manners, the two most preferred being as an element of a dispenser-controlled fitting procedure and as an integrated part of an adaptive hearing aid suitable for use in an adaptive fitting process. These are described below and are shown schematically in block diagrams of the drawings FIG. 1 and FIG. 2.

Figure 1:
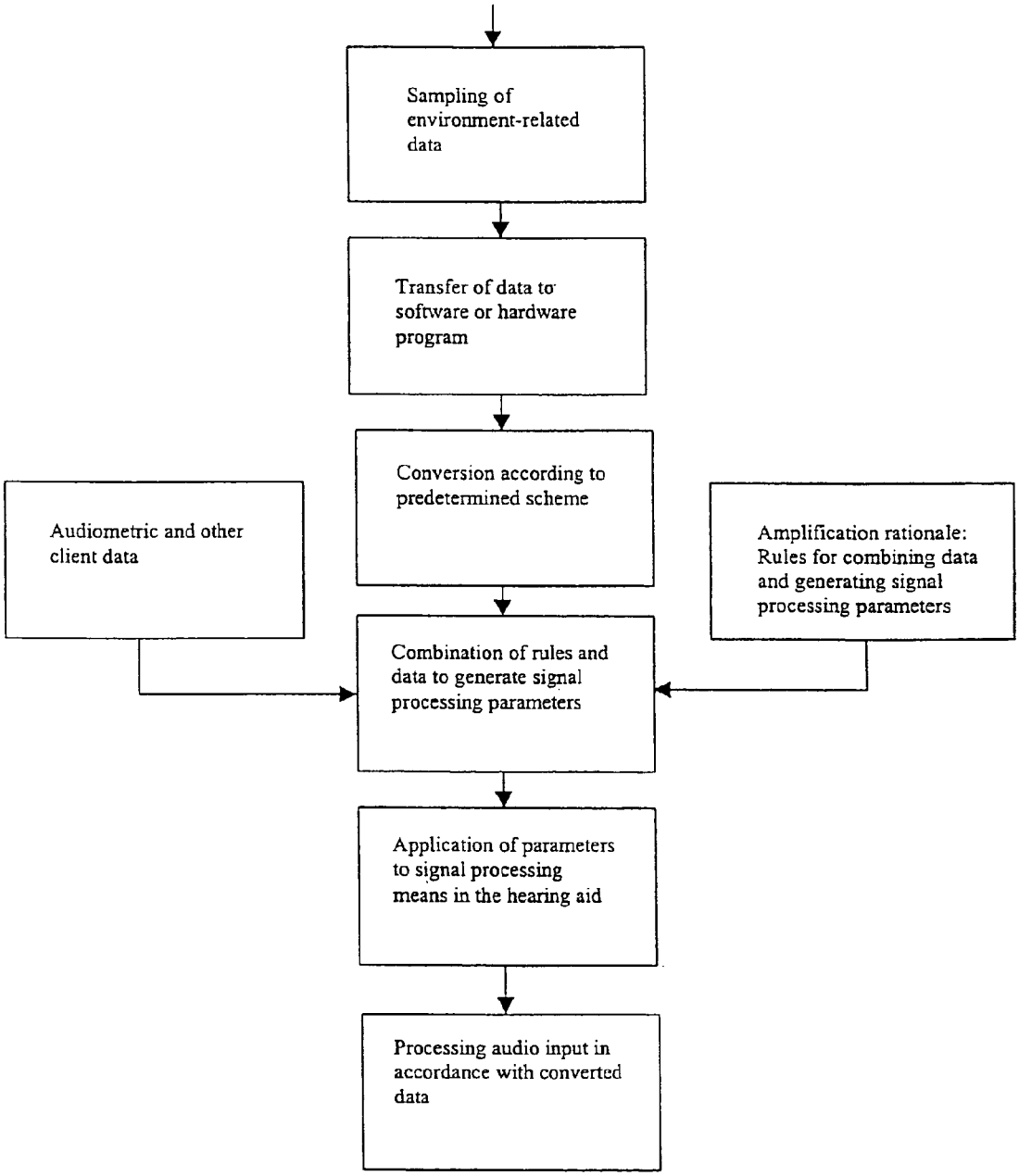
FIG. 1 is a diagram showing the invention as an element of a dispenser-controlled fitting procedure.

Referring now to FIG. 1 the invention implemented as a part of a dispenser-controlled procedure is explained. Typically, a hearing aid client does not receive a hearing aid at the first visit to the dispenser, but at a later date (for example after an ear mould has been manufactured from an ear impression). With the present invention, instead of going home empty-handed to wait for the ear mould to be produced, the client is given a portable or wearable device which contains one or more physical sensors, some signal processing and a datalogger, and optionally includes a means for registering time intervals which the client considers to present environments of particular importance. Whilst the client wears this device, it collects data on the environments experienced by the client. These data are used to improve the prescription of the final hearing aid when the client returns to the dispenser. Data to collect would very likely include levels and spectral distributions of sound across time, but need not be restricted to acoustical quantities if others are found to correlate with optimal hearing aid settings; possible candidates include but are not restricted to ambient or body temperature, light levels, amount of movement, cardiovascular activity, psychological stress.

Figure 2:
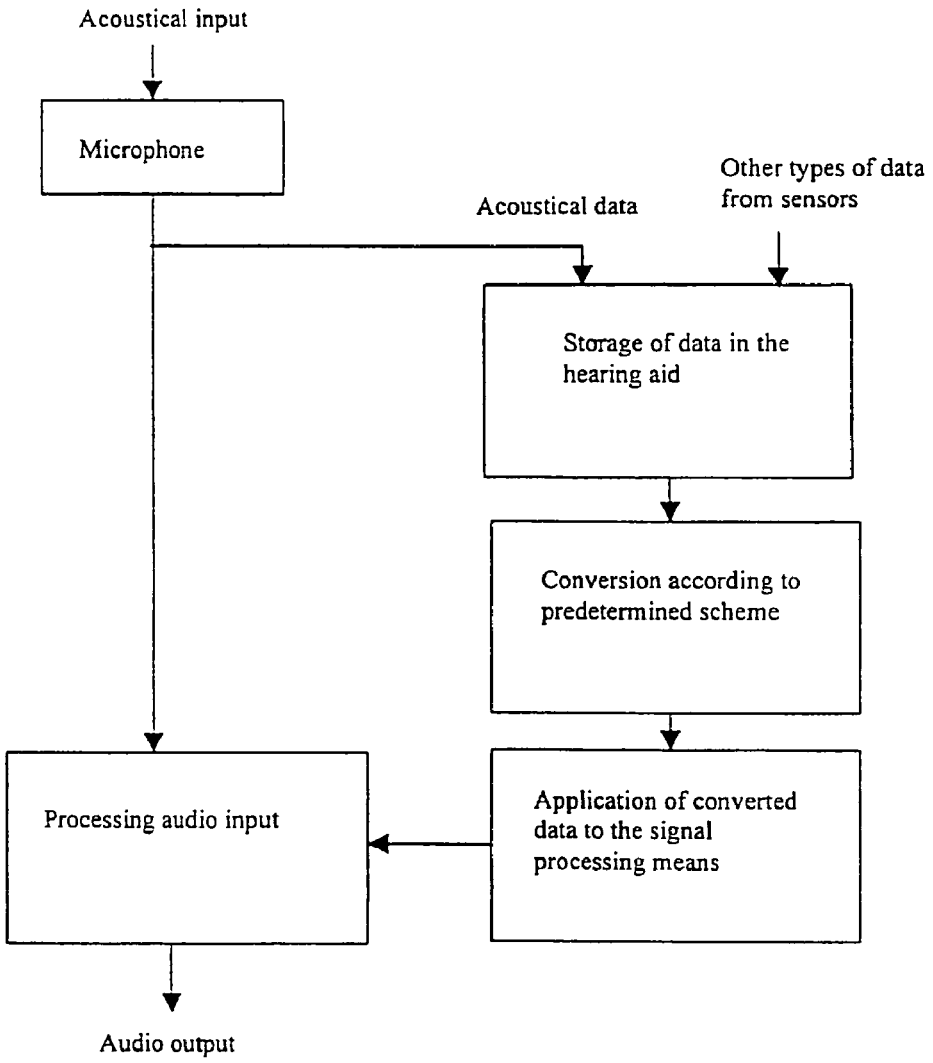
FIG. 2 is a diagram showing the invention as an integrated part of an adaptive hearing aid.

Referring now to FIG. 2 the invention implemented as a part of a hearing aid is explained. At the initial fitting session, the client's hearing aid is adjusted according to some standard prescriptive approach, or indeed by application of the method embodied above. Thereafter, with the present invention, the hearing aid itself acts as a data collector, and includes means for using the data collected to generate alterations to the initial settings provided by the dispenser. These alterations might come into play automatically or when activated by the client. Such an embodiment would make it possible for the hearing aid itself to adjust its signal processing parameters as a consequence of for example altered social behavior resulting from hearing aid use or altered relative importance of different environments for the user.

As an example of the invention embodied as an element of a dispenser-controlled fitting procedure, the following could be the case: A hearing impaired person has been provided with a measuring and recording device for collecting statistical data from the environments which have importance for that person. The statistical data are afterwards, i.e., after a few days recording, analyzed by the hearing aid dispenser. This analysis may be done manually or may be done by a computer according to a program adapted for such analysis. The results of the analysis are afterwards used by the dispenser for selecting the correct initial adjustment of the hearing aid, which most often involves the selection of an amplification rationale that suits the person's hearing loss and afterwards tuning the parameters according to the actual needs indicated by the analysis of the environmental recording. For example, a person whose environments contain unusually high levels of high frequency components will need a lower high frequency gain.

The invention claimed is:

1. A device for fitting a hearing aid to the needs of a user comprising: collecting means for attachment to the user for collecting statistical data over time which characterize physical or psychological properties of environments through which the user passes and in which use of the hearing aid is desired, and storage means for storage of the statistical data so that a dispensing person can adjust the hearing aid prior to first or intended next use.

2. A device according to claim 1, where the device comprises a microphone for collecting acoustic signals and transforming these to electrical signals.

3. A device according to claim 2, where the microphone is also used for collecting statistical data characterising acoustical properties of environments in which use of the hearing aid is desired.

4. A device according to claim 2, including a switch for selecting an input mode for sampling environmental data or an operation mode where the normal hearing aid function is activated.

5. A device according to claim 4, where further sensors are provided for detecting non-audio statistical values including light, body temperature, movement, cardiovascular activity, psychological stress.

6. A method for fitting a hearing aid by a dispensing person to the needs of a hearing aid user prior to first or intended next use, the method comprising placing a data collecting device for statistical data characterizing physical or psychological properties of environments on the user, collecting data in the collecting device over time as the user passes through environments in which the hearing aid is to be used, returning the collecting device to the dispensing person, and manually adjusting the signal processing in the hearing aid based on the statistical data obtained from the collecting device by the dispensing person.

7. A method according to claim 6, wherein the dispensing person adjusts a software program in the hearing aid.

8. A method according to claim 6, where the statistical data relating to physical characteristics of environments are coupled with data relating to the significance of these same environments to the user.

9. A method according to claim 6, wherein as statistical data is collected an acoustical input signal is processed and output to the user's ear.

10. A method for fitting a hearing aid to the needs of a hearing aid user, the method comprising: placing a data collection device on the user, collecting in the data collection device statistical data characterizing physical or psychological properties of environments through which the user passes and in which use of the hearing aid is desired, providing data regarding significance of said collected statistical data to the hearing aid user, combining the collected statistical data with the data regarding significance of said collected statistical data to the hearing aid user to provide adjustment data, and adjusting signal processing parameters of said hearing aid based on said adjustment data.

11. A method for fitting a hearing aid to the needs of a hearing aid user, the method comprising: placing a data collecting device on the user prior to first or current period use of the hearing aid, collecting statistical data characterizing physical or psychological properties of environments through which the user passes and in which use of the hearing aid is desired, and utilizing the statistical data for adjusting signal processing in the hearing aid.

* * * * *